US006113464A

United States Patent [19]

Ohmori et al.

[11] Patent Number: 6,113,464

[45] Date of Patent: Sep. 5, 2000

[54] METHOD FOR MIRROR SURFACE GRINDING AND GRINDING WHEEL THEREFORE

[75] Inventors: Hitoshi Ohmori; Katsuhiko Karikomi, both of Tokyo, Japan

[73] Assignee: Rikagaku Kenkyusho, Saitama-ken, Japan

[21] Appl. No.: 08/742,447

[22] Filed: Nov. 1, 1996

Related U.S. Application Data

[60] Continuation of application No. 08/380,615, Jan. 30, 1995, abandoned, which is a division of application No. 08/079,379, Jun. 21, 1993, abandoned.

[30] Foreign Application Priority Data

| | | | |
|---|---|---|---|
| Jun. 19, 1992 | [JP] | Japan | 159882 |
| Mar. 4, 1993 | [JP] | Japan | 44143 |

[51] Int. Cl.[7] ..... B24B 1/00

[52] U.S. Cl. ..... 451/41; 451/56

[58] Field of Search ..... 451/63, 41, 56, 451/541, 550; 205/662, 663

[56] References Cited

U.S. PATENT DOCUMENTS

| | | | |
|---|---|---|---|
| 3,905,162 | 9/1975 | Lawrence et al. | 451/63 X |
| 4,064,660 | 12/1977 | Lampert | 451/63 X |
| 4,236,985 | 12/1980 | Grodzinsky et al. . | |
| 4,448,656 | 5/1984 | Kuromatsu | 205/663 X |
| 4,512,859 | 4/1985 | Inoue | 205/662 |
| 4,588,473 | 5/1986 | Hisatomi et al. | 451/63 X |
| 4,849,599 | 7/1989 | Kuromatsu . | |
| 4,977,710 | 12/1990 | Une . | |
| 5,157,876 | 10/1992 | Medellin | 451/63 X |
| 5,313,742 | 5/1994 | Corcoran, Jr. et al. | 451/541 |

FOREIGN PATENT DOCUMENTS

| | | | |
|---|---|---|---|
| 1251037 | 11/1986 | Japan | 451/63 |
| 722803 | 3/1992 | U.S.S.R. . | |

OTHER PUBLICATIONS

Japanese Patent Abstract Publication No. 1–188266, date Jul. 27, 1989.

Japanese Patent Abstract Publication No. 02–095574, date Apr. 6, 1990.

Japanese Patent Abstract Publication No. 02–232162, date Sep. 14, 1990.

Japanese Patent Abstract Publication No. 02–232163, date Sep. 14, 1990.

Japanese Patent Abstract Publication No. 04–25365, date Jan. 29, 1992.

Japanese Patent Abstract Publication No. 04–115867, date Apr. 16, 1992.

Japanese Patent Abstract Publication No. 04–275874, date Oct. 1, 1992.

Japanese Patent Abstract Publication No. 54–84686, date May 7, 1979.

(List continued on next page.)

*Primary Examiner*—Timothy V. Eley
*Attorney, Agent, or Firm*—Griffin & Szipl, P.C.

[57] ABSTRACT

An apparatus and a method for mirror surface grinding which enables high quality, stable ELID grinding; and a grinding wheel for electrolytic dressing. The apparatus comprises a grinding wheel 3 having a contact surface 2 for contacting a workpiece 1, an electrode 4 facing the surface 2, nozzles 5 for supplying conductive fluid between the grinding wheel 3 and the electrode 4, and a power source 6 and feeder 7 for applying a voltage between the grinding wheel and the electrode 4. The bond material, which is selected from among iron, ferrous metal, cobalt, nickel and combinations of two or more thereof, along with grains and sintering aid are molded together and sintered to obtain the conductive grinding wheel. Next, a conductive water-soluble grinding fluid containing an alkanolamine and anions is supplied between the grinding wheel and the electrode, and a pulse wave voltage is applied between the grinding wheel and the electrode to dress the grinding wheel electrolytically during grinding.

13 Claims, 7 Drawing Sheets

OTHER PUBLICATIONS

Japanese Patent Abstract Publication No. 62–120918, date Jun. 2, 1987.
Japanese Patent Abstract Publication No. 62–124869, date Jun. 6, 1987.
Japanese Patent Abstract Publication No. 62–176765, date Aug. 3, 1987.
Japanese Patent Abstract Publication No. 62–246472, date Oct. 27, 1987.
Japanese Patent Abstract Publication No. 02–65972, date Mar. 6, 1990.
Japanese Patent Abstract Publication No. 2–76680, date Jul. 27, 1989.
Japanese Patent Abstract Publication No. 02–76679, date Mar. 16, 1990.
Japanese Patent Abstract Publication No. 02–100872, date Apr. 12, 1990.
Japanese Patent Abstract Publication No. 02–185318, date Jul. 19, 1990.
Japanese Patent Abstract Publication No. 02–218554, date Aug. 31, 1990.
Japanese Patent Abstract Publication No. 02–256462, date Oct. 17, 1990.
Japanese Patent Abstract Publication No. 02–256419, date Oct. 17, 1990.
Japanese Patent Abstract Publication No. 03–111142, date May 10, 1991.
Japanese Patent Abstract Publication No. 02–298463, date Dec. 10, 1990.
Japanese Patent Abstract Publication No. 03–43144, date Feb. 25, 1991.
Japanese Patent Abstract Publication No. 03–43145, date Feb. 25, 1991.
Japanese Patent Abstract Publication No. 03–60974, date Mar. 15, 1991.
Japanese Patent Abstract Publication No. 03–73268, date Mar. 28, 1991.
Japanese Patent Abstract Publication No. 03–86472, date Apr. 11, 1991.
Japanese Patent Abstract Publication No. 03–92257, date Apr. 11, 1991.
Japanese Patent Abstract Publication No. 03–92368, date Apr. 17, 1991.
Japanese Patent Abstract Publication No. 03–111161, date May 10, 1991.
Japanese Patent Abstract Publication No. 03–117549, date May 20, 1991.
Japanese Patent Abstract Publication No. 03–121776, date May 23, 1991.
Japanese Patent Abstract Publication No. 03–136764, date Jun. 11, 1991.
Japanese Patent Abstract Publication No. 03–136758, date Jun. 11, 1991.
Japanese Patent Abstract Publication No. 03–166056, date Jul. 18, 1991.
Japanese Patent Abstract Publication No. 03–170266, date Jul. 23, 1991.
Japanese Patent Abstract Publication No. 03–190667, date Aug. 20, 1991.
Japanese Patent Abstract Publication No. 03–239471, date Oct. 25, 1991.
Japanese Patent Abstract Publication No. 03–239472, date Oct. 25, 1991.
Japanese Patent Abstract Publication No. 03–239473, date Oct. 25, 1991.
Japanese Patent Abstract Publication No. 03–251352, date Nov. 8, 1991.
Japanese Patent Abstract Publication No. 03–251353, date Nov. 8, 1991.
Japanese Patent Abstract Publication No. 04–35869, date Feb. 6, 1992.
Japanese Patent Abstract Publication No. 04–46764, date Feb. 17, 1992.
Japanese Patent Abstract Publication No. 04–53628, date Feb. 21, 1992.
Japanese Patent Abstract Publication No. 04–75873, date Mar. 10, 1992.
Japanese Patent Abstract Publication No. 04–101779, date Apr. 3, 1992.
Japanese Patent Abstract Publication No. 04–105871, date Apr. 7, 1992.
Japanese Patent Abstract Publication No. 04–111771, date Apr. 13, 1992.
Japanese Patent Abstract Publication No. 04–135174, date May 8, 1992.
Japanese Patent Abstract Publication No. 04–141375, date May 14, 1992.
Japanese Patent Abstract Publication No. 04–159079, date Jun. 2, 1992.
Japanese Patent Abstract Publication No. 04–164570, date Jun. 10, 1992.
Japanese Patent Abstract Publication No. 04–183573, date Jun. 30, 1992.
Japanese Patent Abstract Publication No. 04–193476, date Jul. 13, 1992.
Japanese Patent Abstract Publication No. 04–193477, date Jul. 13, 1992.
Japanese Patent Abstract Publication No. 04–348870, date Dec. 3, 1992.
Japanese Patent Abstract Publication No. 04–294975, date Oct. 19, 1992.
Japanese Patent Abstract Publication No. 04–304966, date Oct. 28, 1992.
Japanese Patent Abstract Publication No. 04–315573, date Nov. 6, 1992.
Japanese Patent Abstract Publication No. 04–322970, date Nov. 12, 1992.
Japanese Patent Abstract Publication No. 04–336958, date Nov. 25, 1992.
6001 Chemical Abstracts, 99:16582e, vol. 99 (1983) Nov., No. 20, p. 474, Columbia, Ohio, USA.
1323 Russian Engineering Research, vol. 7, No. 12 (1987) Dec., Melton, Mowbray, Great Britain.
Communication dated Nov. 15, 1993; Partial European Search Report dated Oct. 7, 1993.

| Grain Size | #400 | #1200 | #2000 | #3000 | #4000 | #6000 | #8000 |
|---|---|---|---|---|---|---|---|
| Rmax | 319.0 | 199.5 | 107.5 | 67.5 | 59.5 | 53.5 | 37.5 |
| Ra | 34.2 | 23.2 | 14.6 | 8.0 | 7.6 | 6.6 | 5.2 |

Unit: nm

METHOD FOR MIRROR SURFACE GRINDING AND GRINDING WHEEL THEREFORE

This application is a continuation of Ser. No. 08/380,615, filed Jan. 30, 1995, now abandoned which was a divisional of Ser. No. 08/079,379 filed Jun. 21, 1993, now abandoned.

FIELD OF THE INVENTION

The present invention relates to an apparatus and a method for mirror surface grinding and a grinding wheel for grinding a mirror surface. More particularly, the present invention relates to an apparatus and a method for electrolytically dressing a conductive grinding wheel and for grinding a workpiece to a mirror surface finish with the grinding wheel. The present invention also relates to a grinding wheel exhibiting mechano-chemical action for electrolytic dressing.

DESCRIPTION OF THE PRIOR ART

In the 1960's, Norton Company of the USA achieved electrolytic dressing of grinding wheels by reversing the potential between the grinding wheel and the workpiece in conventional electrolytic grinding. In 1983, The Mechanical Engineering Laboratory of the Japanese Agency of Industry and Science Technology reported in Japanese Patent Publication No. 63-9945 that stable cutting could be obtained by (1) applying a direct current between a bronze bonded grinding wheel and an electrode, and (2) supplying a grinding fluid as an electrolyte between the grinding wheel and the electrode. However, since the above electrolytic dressing methods use bronze metal bonded wheels, a direct current power supply, and a conventional grinding fluid as an electrolyte, they can be used only for rough grinding. A high quality finish such as a mirror surface can not be obtained by such grinding methods.

In 1987, the inventor of the present invention succeeded in obtaining mirror surfaces by a new finish grinding technique. The technique used a semiconductor such as a silicon wafer, and an electrically conductive wheel such as a cast iron fiber bonded diamond wheel (CIFB). The grinding wheel was electrolytically dressed by applying a voltage between the wheel and the workpiece while the workpiece was being ground by the wheel. The inventor reported this technique as "METHOD AND APPARATUS FOR ELECTROLYTIC DRESSING OF ELECTRICALLY CONDUCTIVE GRINDING WHEEL" (Japanese Patent Public Disclosure No.1-188266, Japanese Patent Application No.63-12305, Jan. 22, 1988). Further, the inventor developed a technique called "ELID grinding" (Electrolytic In-Process Dressing) which was reported at a symposium held by The Institute of Physical and Chemical Research (RIKEN) ("Recent Trends in Mirror Surface Grinding Technology", May 5, 1991).

The apparatus for ELID grinding comprises a grinding wheel having a contact surface for contact with the workpiece, an electrode facing the contact surface, nozzles for supplying grinding fluid as an electrolyte between the wheel and the electrode, and a power source and feeder for applying a voltage between the wheel and the electrode. The method of ELID grinding comprises: supplying the grinding fluid between the wheel and the electrode, applying the voltage between the wheel and the electrode, and dressing the wheel electrolytically.

FIG. 13 (PRIOR ART) shows the mechanism of the electrolytic dressing according to ELID—grinding. At the time of pre-dressing (see portion A of FIG. 13), when grains 130 protrude from the wheel, the electrical resistance between the wheel and the electrode is low so that electric current between the wheel and the electrode is relatively high (5–10 A). Therefore, the bond material on the surface of the wheel is dissolved electrolytically, producing, for example, FE+2 ions and the non-conductive diamond grains are exposed. After a number of grains have been exposed (portion B of FIG. 13), an insulating or non-conductive film 132 comprising iron oxide ($Fe_2O_3$) is formed on the surface of the grinding wheel so that the electric resistance of the wheel is increased. Therefore, the electric current and the dissolution of the bond material both decrease, and the exposure of the grains is virtually completed. Under the conditions shown in FIG. 13B, grinding by the wheel is started. As a result, insulating film and diamond grains are scraped off and removed while the workpiece is ground by the grinding wheel (portion C of FIG. 13). When the grinding is continued (portion D of FIG. 13), the insulating film is worn off the surface of the grinding wheel so that the electrical resistance of the wheel decreases and the electric current between the grinding wheel and the electrode increases. As a result, the dissolution of the bond material increases, and the exposure of the grains is started again.

As mentioned above, during ELID grinding, the formation and removal of the insulation film occurs as shown in FIGS. 13B to 13D, the dissolution of the bond material is regulated automatically, and the exposure of the grains is also automatically controlled (the process shown in FIGS. 13B to 13D is hereinafter called the "ELID cycle").

In the above-mentioned ELID grinding, even if the grains are very fine, choking of the wheel does not occur because the grains are automatically exposed by the ELID cycle. Therefore, by using very fine grains, excellent surfaces having mirror surfaces can be obtained by ELID grinding. Consequently, ultra precision mirror surfaces can be obtained by ELID grinding 10 times faster than by conventional polishing.

However, even in ELID grinding, the grinding speed and the quality of the finished surfaces are strongly influenced by the properties of the wheel, power source, and grinding fluid. Therefore, among ELID grindings conducted under almost the same conditions, only very few produce ultra precision mirror surfaces. Although ultra-precision mirror surfaces were regularly obtained in the laboratory, for example, even when the same apparatus was used, due to the use of different water (such as city water or well water) for diluting the same grinding fluid, mirror surfaces having the same quality could not be obtained outside the laboratory. Furthermore, because some factors affecting the grinding results are not clear despite many tests carried out under various conditions, ultra precision mirror surfaces could rarely be obtained by ELID grinding.

Therefore, it is an object of the present invention to clarify the factors affecting ELID grinding, and to provide an apparatus and method for mirror surface grinding which enable ultra precision mirror surfaces to be obtained with high reliability.

It is considered common sense to use diamonds or CBN, (Cubic System Boron Nitride), the so-called "Superabrasives" as the abrasive grains of the grinding wheel. This is because these grains are so extremely hard that they can grind almost any material. However, even when diamond or CBN grains are used, the grinding efficiency is very low if the average grain size is very small. For example, to obtain a mirror surface having a maximum surface roughness ($R_{max}$) below 50 to 60 nm, it is necessary to use a grinding wheel having #800 diamond grains (average grain size: 1.76 μm), and, therefore, the grinding time required for obtaining a mirror surface is twice or more than that for surfaces ground by using a #2000 grinding wheel (average grain size: 6.88 μm). Furthermore, to obtain the mirror surfaces, it is necessary to change the grinding wheel many times, progressing from rough wheels to fine wheels. Therefore, many steps have been necessary for obtaining the desired mirror surface.

Mechano-chemical polishing is also well known for use in obtaining mirror surfaces. In mechano-chemical polishing, chemical polishing and mechanical polishing take place simultaneously. This is achieved by using a mixed polishing fluid containing polishing abrasives and chemical fluid. However, because mechano-chemical polishing polishes the workpiece using polishing abrasives absorbed to cloth, the polishing speed is very low. The polishing time is therefore 50 to 100 times longer than that of ELID grinding.

Furthermore, in mechano-chemical polishing, sliding surfaces of the polishing apparatus are sometimes damaged by the numerous abrasive particles suspended in the polishing fluid.

The area around the apparatus is also fouled by the polishing fluid.

It is therefore another object of the present invention is to provide a grinding wheel which is more efficient than a grinding wheel containing diamond or CBN grains, and which can be used for electrolytic dressing to grind mirror surfaces.

A further object of the present invention is to provide a highly efficient grinding wheel without using expensive diamond or CBN grains, and which can be used for electrolytic dressing to grind mirror surfaces.

A still further object of the present invention is to provide a grinding wheel which does not damage the sliding surfaces of the apparatus or foul the area around the apparatus.

SUMMARY OF THE INVENTION

According to a first embodiment of the invention, the above and other objects can be accomplished by providing an apparatus for mirror surface grinding comprising: a conductive grinding wheel having a contact surface for contacting a workpiece, the grinding wheel being formed by sintering, at a high temperature, grains, bond material and sintering aid, wherein the bond material is selected from the group consisting of cast iron, ferrous metal, cobalt, nickel and a combination of two or more thereof, and wherein the grains are diamond or CBN grains of an average grain size of not more than 6gm; an electrode facing the contact surface; a plurality of nozzles for supplying conductive fluid between the grinding wheel and the electrode; and an electrical power source and a feeder for applying a voltage between the grinding wheel and the electrode; whereby the grinding wheel is electrolytically dressed while the workpiece is ground by the grinding wheel.

In accordance with a second embodiment of the present invention, there is provided an apparatus for mirror surface grinding comprising: a conductive grinding wheel having a contact surface for contacting a workpiece; an electrode facing the contact surface; a plurality of nozzles for supplying conductive fluid between the grinding wheel and the electrode; and an electrical power source and a feeder for applying voltage between the grinding wheel and the electrode, wherein the voltage is a pulse wave; whereby the grinding wheel is electrolytically dressed while the workpiece is ground by the grinding wheel.

In the apparatus for mirror surface grinding, the pulse wave is preferably a pure pulse wave or a ripple pulse wave obtained by adding a constant voltage to a pure pulse wave. It is preferable for the pure pulse wave to vary from about 0 V to about 60V. If a ripple pulse wave is used, it is preferable for the pure pulse wave to vary from about 0 V to about 60V, and for the constant voltage to be about 20 V, so that the ripple pulse wave obtained by adding the constant voltage to the pure pulse wave varies from about 0 V to about 60V.

Furthermore, according to a third embodiment of the present invention, there is provided an apparatus for mirror surface grinding comprising: a conductive grinding wheel having a contact surface for contacting a workpiece; an electrode facing the contact surface; a plurality of nozzles for supplying conductive fluid between the grinding wheel and the electrode, wherein the conductive fluid is water soluble and contains an inorganic salt, an alkanolamine and an anion; and an electrical power source and a feeder for applying a voltage between the grinding wheel and the electrode; whereby the grinding wheel is electrolytically dressed while the workpiece is ground by the grinding wheel. In the apparatus for mirror surface grinding, the inorganic salt is an alkaline metal salt of one of carbonate, silicate and molybdate, and contains cations of molybdenum, sodium and potassium. It is preferable that the anion comprise at least one of chlorine ion ($Cl^-$), nitrate ion ($NO_3^-$) or sulfate ion ($SO_4^{--}$). It is more preferable for the concentration of chlorine ion ($Cl^-$) to be from 10 to 14 ppm.

According to the fourth embodiment of the present invention, there is provided a method for mirror surface grinding comprising: molding a conductive grinding wheel having a contact surface for contacting a workpiece, from grains, bonding material and sintering aid, wherein the bonding material is selected from the group consisting of cast iron, ferrous metal, cobalt, nickel or a combination of one or more members of the group; sintering the grinding wheel at a high temperature; disposing an electrode to face the contact surface; supplying conductive fluid containing an inorganic salt, an alkanolamine and an anion between the grinding wheel and the electrode; applying a pulse wave voltage between the grinding wheel and the electrode; and electrolytically dressing the grinding wheel while grinding the workpiece with the grinding wheel.

A further embodiment of the invention is aimed at obtaining a chemical removing effect together with the mechanical grinding effect by replacing the diamond or CBN grains with a metal oxide exhibiting mechano-chemical action. The present inventor discovered that although the hardness of the metal oxide exhibiting the mechano-chemical action is less than that of diamond or CBN grains, the fact that the edges of the metal oxide grains are not as sharp as those of the diamond or CBN grains makes it possible to achieve high efficiency grinding of a mirror surface with relatively large grains by applying the chemical removing effect of the mechano-chemical action together with the mechanical grinding effect.

Therefore, according to a fifth embodiment of the invention, the above and other objects can be accomplished by a grinding wheel for electrolytic dressing comprising: grains consisting of metal oxide exhibiting a mechano-chemical action, and metal binder for retaining the grains. In the grinding wheel for electrolytic dressing, the metal oxide exhibiting the mechano-chemical action can be any of cerium oxide, chromium oxide, zirconium oxide and silicon oxide. In addition, the metal binder can be any of iron powder, cast iron powder and cobalt powder. Further, it is preferable for the metal binder to contain a very small quantity of sintering aid. The sintering aid in the grinding wheel for electrolytic dressing may be carbonyl iron powder. The grain concentration of the grains exhibiting a mechanochemical action may preferably be from 50 to 200.

According to the first to fourth embodiments of the invention, the grinding wheel may be formed by sintering, at high temperature, grains, bonding material and sintering aid, wherein the bonding material is selected from the group consisting of cast iron, ferrous metal, cobalt, nickel or a combination of two or more members of the group, and wherein the grains are diamond or CBN of an average grain size of not more than 6 $\mu$m. Therefore, the grinding wheel has sufficient strength to almost completely resist wear from contact with the workpiece, the grains in the grinding wheel can be exposed by the electrolytic dressing, and a non-conductive film consisting of a hydroxide or oxide can be easily formed on the surface of the grinding wheel. Mirror surfaces of good quality can thereby be reliably obtained by ELID grinding.

Because the voltage is a pulse wave, the non-conductive film assumes a suitable thickness after an appropriate period so that the electric current becomes constant, whereby mirror surfaces of good quality can be reliably obtained by ELID grinding.

Because the conductive fluid is a water-soluble grinding fluid and contains an inorganic salt, an alkanolamine, and an anion, the electrolytic dressing properties and electrical conductance are maintained at proper levels during ELID grinding. In addition, the insulation film works as a lubricant between the grinding wheel and the workpiece, a complex is formed with the metal ion in the bond material thereby accelerating the elution of the bond material, the grinding fluid is kept alkaline, corrosion protection is maintained, and the insulation film becomes porous to thereby maintain steady elution of the bond material. For the above additional reasons, mirror surfaces of good quality can be reliably obtained by ELID grinding.

According to the fifth embodiment of the invention the grinding wheel for electrolytic dressing contains grains consisting of a metal oxide that exhibit mechano-chemical action. Thus, since the grains that produce a mechano-chemical action are retained in a metal binder, ELID grinding can be performed in accordance with the above mentioned ELID cycle.

It is thought that when the metal oxide contacts the grinding surface it works as a catalyst causing the material in the workpiece to bond covalently with water molecules during the mechano-chemical action. As a result, the surface of the workpiece is softened and can be easily ground by relatively soft grains. Accordingly, although the hardness of the metal oxide exhibiting mechano-chemical action is lower than that of the diamond or CBN grains, highly efficient grinding can be obtained by using the chemical removing effect together with the mechano-chemical action. Furthermore, because the metal oxide grains are not as sharp as the diamond or CBN grains, mirror surfaces of good quality can be obtained with relatively large grains.

Therefore, according to the fifth embodiment of the invention, it is possible to provide a grinding wheel which is more efficient than a grinding wheel containing diamond or CBN grains and which can be electrolytically dressed while being used to grind mirror surface. In addition, as such metal oxide is relatively inexpensive, mirror surfaces of good quality can be obtained at reduced cost without using expensive diamond or CBN grains. Furthermore, since the conductive fluid according to the fifth embodiment of the invention does not contain any abrasives, the grinding wheel does not damage the sliding surfaces of the apparatus and also does not foul the area around the apparatus.

Further objects, features, and advantages of the present invention will become apparent from the Detailed Description of the Preferred Embodiments which follows, when considered together with the attached drawings.

DESCRIPTION OF THE PREFERRED EMBODIMENTS

Figure 1:
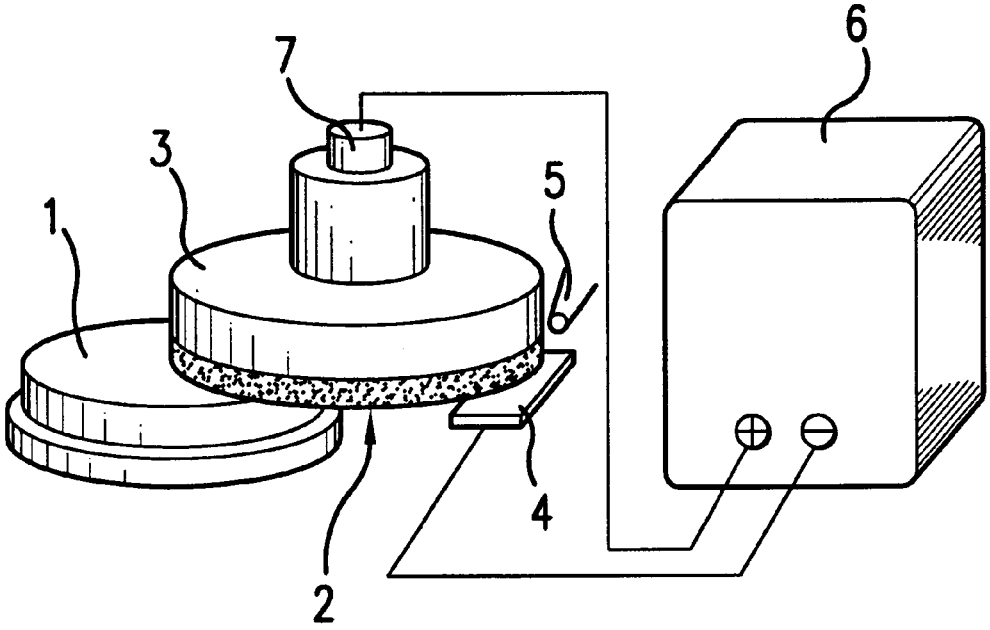
FIG. 1 is a schematic view of the apparatus for mirror surface grinding in accordance with one embodiment of the invention.

FIG. 1 is a schematic view of an apparatus for mirror surface grinding which may embody the first to fourth embodiments of the invention. The apparatus for mirror surface grinding comprises a grinding wheel 3 having a contact surface 2 for contacting a workpiece 1, an electrode 4 facing the surface 2, nozzles 5 for supplying a conductive fluid between the grinding wheel 3 and the electrode 4, and a power source 6 and feeder 7 for applying a voltage between the grinding wheel and the electrode 4. While the conductive fluid is being supplied between the grinding wheel 3 and the electrode 4, a voltage is applied between the grinding wheel 3 and the electrode 4 so that the grinding wheel 3 is dressed electrolytically.

Figure 2:
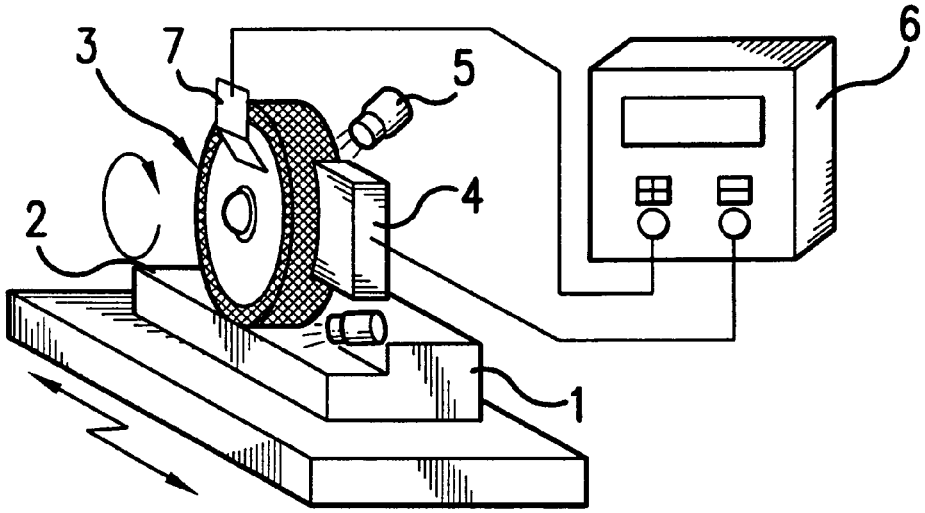
FIG. 2 is a schematic view of a mirror surface grinding apparatus in accordance with another embodiment of the invention.

The illustrated configuration of the apparatus for mirror surface grinding is merely one example, and ELID grinding can also be conducted according to the ELID grinding method mentioned above using various other configurations. For example, as shown in FIG. 2, the apparatus can be used for flat grinding.

The bond material used for fixing the grains in the grinding wheel is preferably a conductive material which (a) is strong enough to almost completely resist wear through contact with the workpiece, (b) enables the grains to be dressed electrolytically, and (c) enables a non-conductive film such as a hydroxide or oxide to easily form thereon. Bronze, for example, is not suitable because of its insufficient strength, but cast iron, ferrous metal, cobalt and nickel are suitable. Combinations of two or more these metals are also suitable. For example, a composite binder of steel and cobalt can be used.

The grains are preferably diamond or CBN grains, or a combination thereof. The grain size used for mirror surface grinding is in the range of #2000 to #10000 (grain size number as used herein is defined according to the Japanese Industrial Standard (JIS)). Specifically, the average diameter of the grains is not more than 6 $\mu$m.

The grinding wheel is preferably obtained by molding the bond material and the grains together with sintering aid and sintering the molded article. Accordingly, the grinding wheel is preferably a cast iron fiber bonded grinding wheel, cast iron bonded grinding wheel, ferrous metal bonded grinding wheel, cobalt bonded grinding wheel, or the like.

Figure 3:
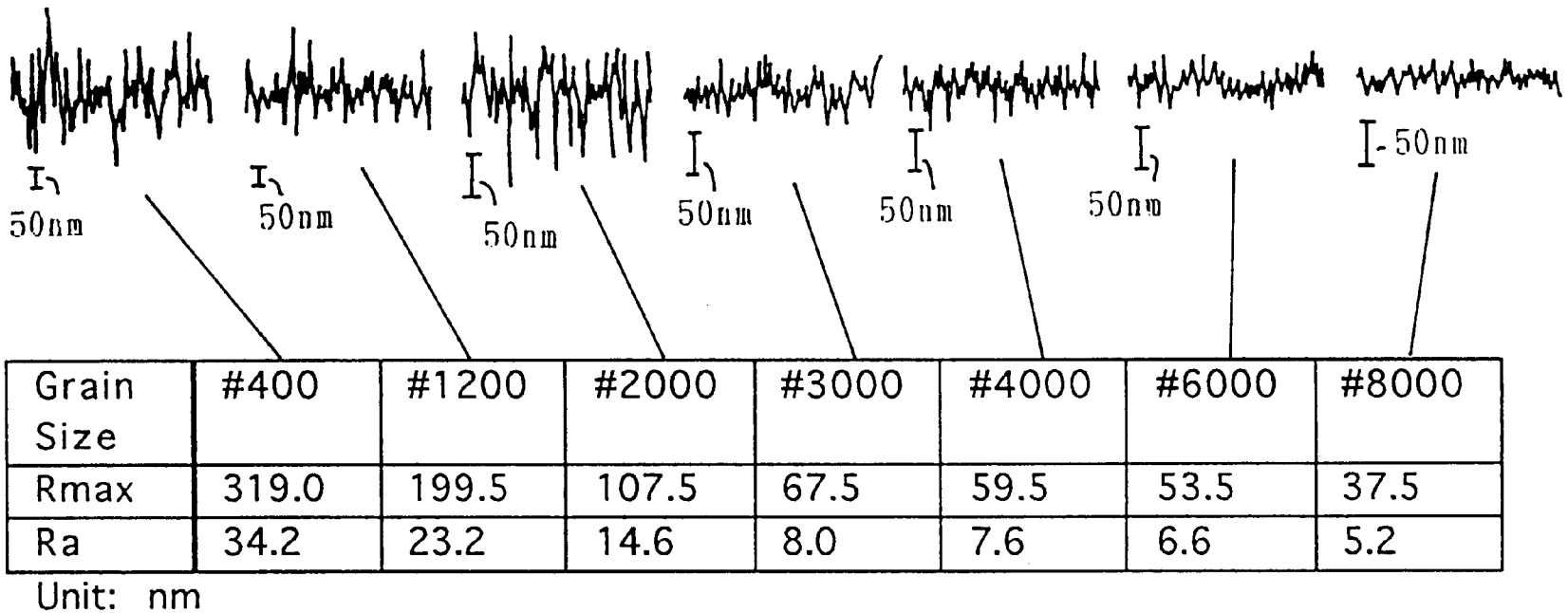
FIG. 3 shows the surface roughnesses of works ground by seven grinding wheels having different average grain sizes ranging from #400 to #8000.
Figure 4:
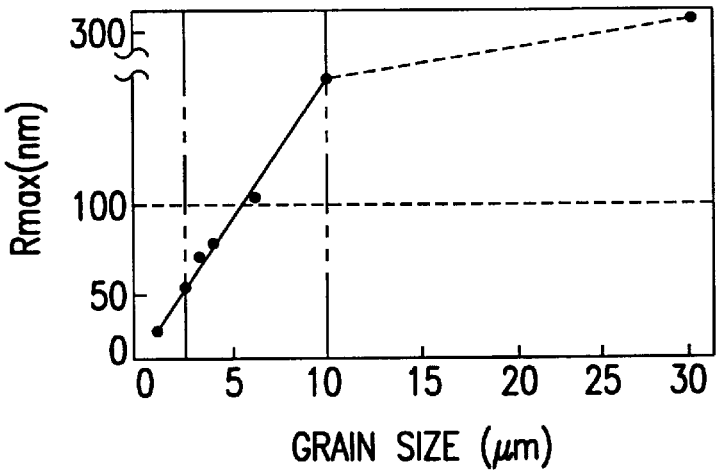
FIG. 4 shows the relationship between average grain size and maximum surface roughness ($R_{max}$).

FIG. 3 shows the surface roughnesses of works ground with the apparatus for mirror surface grinding shown in FIG. 1 using seven kinds of grains having average grain sizes of #400 to #8000. The symbol $R_a$ in FIG. 3 means average surface roughness, and $R_{max}$ means maximum surface roughness. Both $R_a$ and $R_{max}$ are measured according to the Japanese Industrial Standard (JIS). FIG. 4 shows the relationship between average grain size and surface roughness ($R_{max}$). It is clear from FIG. 3 and FIG. 4 that mirror surfaces can be obtained by using grains having an average grain size of not more than about 6 $\mu$m (not less than #2000).

The type of power suitable for ELID grinding will now be described.

Figure 5:
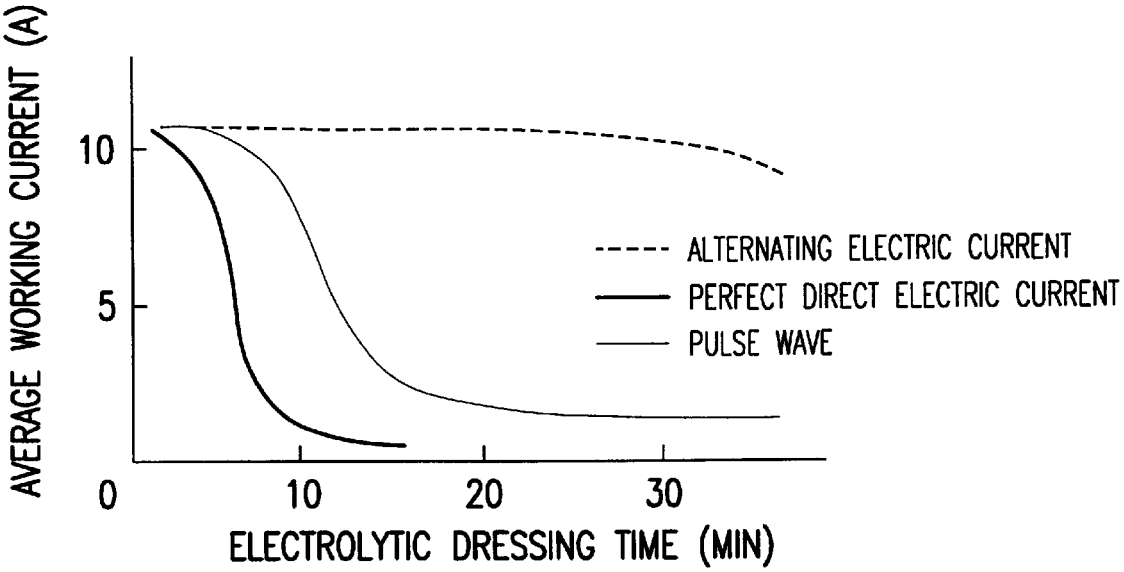
FIG. 5 shows the relationship between electrolytic dressing time and actual average electric current in ELID grinding.

FIG. 5 shows the relationship between electrolytic dressing time (min.) for ELID grinding and the average working current (A). The upper curve is for alternating electric current, the middle one is for a pulse wave, and the lower one is for perfect direct electric current.

The following can be concluded from FIG. 5. When perfect direct electric current is used, the bond material melts vigorously at first, but the current then decreases since a thick film forms in a short period of time. Accordingly, stable ELID grinding cannot be conducted using perfect direct electric current. When alternating electric current is used, electrolysis can be continuously conducted, but a non-conductive film cannot be formed and the current level stays high. Accordingly, electrolytic dressing can be conducted but the ground surface is coarser than that required to produce a mirror surface.

Use of a pulse wave is suitable for ELID grinding. When a pulse wave is used, a non-conductive film with suitable thickness can be formed in a given time, so that the current stays constant. Accordingly, ELID grinding can be conducted stably to obtain a mirror surface. A pure pulse wave or a ripple pulse wave is particularly preferable.

The pure pulse wave is a pulse wave in which the voltage oscillates optimally between 0 V and 60 V, and which can cause electrolytic dissolution and passivation in a suitable balance. It was found that such a pure pulse wave makes it possible to form a non-conductive film having substantially the same thickness as the etching layer (the dissolution layer of the bond material has a thickness of the 2 to 4 $\mu$m) during processing, and attains an in-process dressing effect adequate for maintaining the exposure of fine grains having an average diameter of not more than 6 $\mu$m.

A ripple pulse wave is obtained by adding about 20 V to a pulse wave varying between 0 V and 60 V, and varies between about 20 V and 60 V. Such a ripple wave can provide (1) a higher average voltage than a pure pulse wave, (2) a high electrolysis efficiency and (3) a thick non-conductive film.

The conductive fluid, namely the grinding fluid, will now be described.

The grinding fluid used for ELID grinding is a water-soluble fluid containing for example, an inorganic salt, an alkanolamine and an anion.

The inorganic salt is an alkaline metal salt such as a carbonate, silicate or molybdate, and is preferably a salt of molybdenum, sodium or potassium. The inorganic salt enables maintenance of adequate electrolytes and electric conductivity during ELID grinding and provides an anti-corrosive effect.

Table 1 shows the results of analysis of various processing fluids (grinding fluids). ELID grinding was conducted using these processing fluids. It was found that fluid No. 5 is especially suitable for use in high quality grinding, and that the grinding fluid suitable for ELID grinding should contain cations such as molybdenum, sodium or potassium ions.

TABLE 1

| Fluid | Mo | Mg | Cu | Ca | Si | Na | K | Fe | pH | $\mu$S/cm |
|---|---|---|---|---|---|---|---|---|---|---|
| No. 1 | — | 4.9 | — | 18.6 | 11.3 | 11 | 1 | — | 8.1 | 300 |
| No. 2 | 36 | 4.5 | 3 | 8.0 | 10.2 | 220 | 1325 | 58.3 | 9.1 | 3800 |
| No. 3 | 45 | 2.6 | 11 | 25.6 | 19.6 | 113 | 224 | 0.6 | 9.4 | 2300 |
| No. 4 | 28 | 0.1 | 6 | 0.8 | 38.0 | 196 | 964 | 1.5 | 9.3 | 4500 |
| No. 5 | 16 | 4.0 | — | 0.6 | 9.0 | 96 | 547 | — | 10.5 | 2300 |

Figure 6:
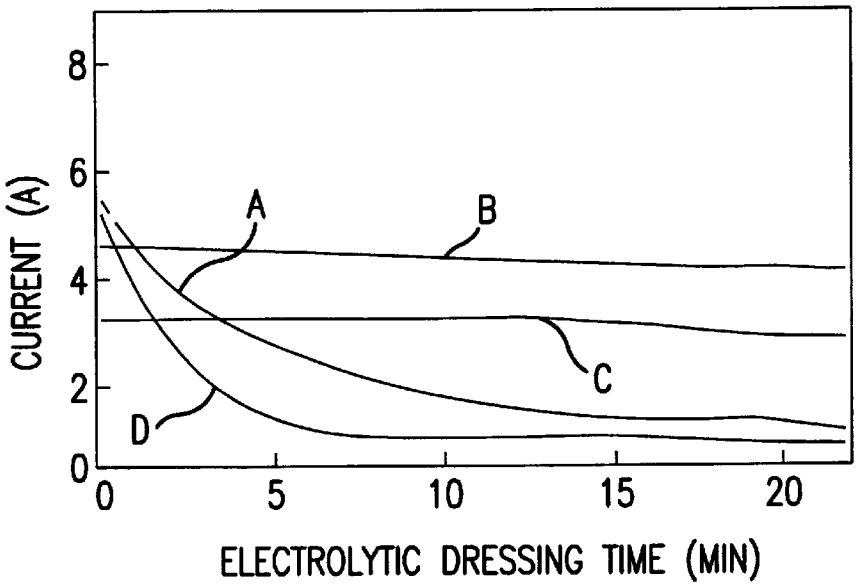
FIG. 6 shows the change in current when silicon nitride is subjected to ELID grinding using various grinding fluids.
Figure 7A:
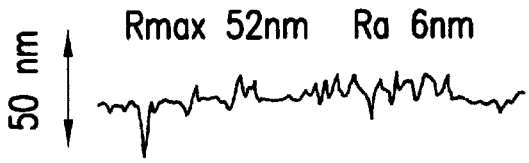
FIG. 7 shows the surface roughnesses of the works of FIG. 6.
Figure 7B:
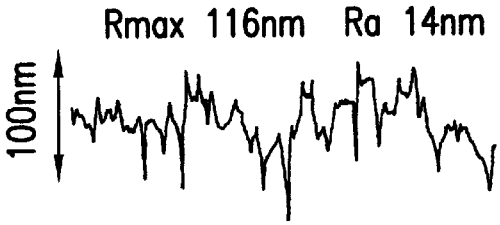
Figure 7C:
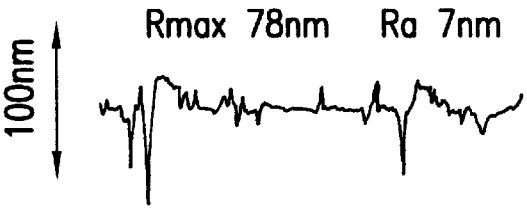
Figure 7D:
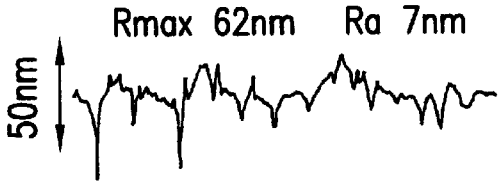

Remarks:
Elemental components are expressed in units of ppm.
No. 1: ground water (not tap water)
No. 2: grinding fluid after use for cylindrical grinding
No. 3: ground water + waste of iron grinding
No. 4: AFG-M + No. 3 fluid (AFG-M is a grinding fluid designed by the inventor.)
No. 5: AFG-M + tap water It was found that molybdenum is especially important for mirror surface grinding, because molybdenum is incorporated in the non-conductive film where it functions as a lubricant when the non-conductive film is in contact with the workpiece. In Table No. 3, the density, pH, conductivity and surface tension of the grinding fluid (A) are compared with those of grinding fluids (B), (C) and (D). FIG. 6 shows change in current when silicon nitride is subjected to ELID grinding using the above fluids. In FIG. 7, the roughnesses of the resultant surfaces are compared. It is apparent that grinding fluids (A) and (D) can provide current characteristics suitable for ELID grinding. It is apparent from FIG. 7 that the fluid (A) containing molybdenum provided a mirror surface of high quality ($R_{max}$ 52 nm), whereas the other fluids provided inferior surface quality ($R_{max}$ 62 to 116 nm)).

TABLE 2

| Property | | A(AFG-M) | B(No. 2) | C(No. 5) | D(No. 3) |
|---|---|---|---|---|---|
| Density | | 1.09 | 1.13 | 1.12 | 1.08 |
| pH | X30 | 10.8 | 9.6 | 9.6 | 9.9 |
| | X50 | 10.7 | 9.4 | 9.5 | 9.9 |
| Conductivity | X30 | 2700 | 3700 | 1250 | 1600 |
| | X50 | 1800 | 2400 | 800 | 1100 |
| Surface | X30 | 63.0 | — | 64.0 | 53.0 |
| tension | X50 | 64.0 | — | 65.0 | 54.0 |

Units:
Density: g/cm$^3$ at 15° C.
Conductivity: $\mu$S/cm
X30: 1 to 30 dilution of grinding fluid to water.
X50: 1 to 50 dilution of grinding fluid to water.
Surface tension: mN/m An alkanolamine is also important for mirror surface grinding. An alkanolamine is an organic compound which forms a complex with metal ions in the wheel bond material, and helps them to dissolve. Furthermore, it keeps the Ph of the grinding fluid alkaline and maintains the anti-corrosive property of the fluid.

The main preferable anions are $Cl^-$, $NO_3^-$ and $SO_4^{--}$. The $Cl^-$ anion is particularly necessary for making the non-conductive film porous so as to attain an anion effect which constantly maintains electrolytic dissolution. When non-chloride ions are present, electrolysis does not proceed, but too many chloride ions result in too thick and too hard a non-conductive film, which causes a loss in dissolution of the bond material and is not suitable for ELID grinding. Table 3 shows the results of quantitative analysis of anions contained in various grinding fluids. As shown in Table 3, grinding fluid No. 3 is the most suitable for ELID grinding. Accordingly, it is found that chloride ion ($Cl^-$) is preferably contained in an amount of 10 to 14 ppm.

TABLE 3

| Sample No. | C1 (ppm) | $NO_3$ (ppm) | $SO_42$ (ppm) |
|---|---|---|---|
| No. 1 | 81.2 | 17.0 | 147.1 |
| No. 2 | 49.6 | 14.5 | 86.8 |
| No. 3 | 7.9 | — | 8.8 |
| No. 4 | 14.0 | 5.9 | 26.0 |
| Undiluted fluid | 13.8 | 9.9 | 20.8 |
| Tap water | 8.08 | 4.85 | 16.8 |

The above mentioned apparatus for mirror surface grinding is used as follows. First, the wheel bond material which comprises iron, ferrous metal, cobalt, nickel or a combination of two or more thereof, grains and sintering aid are molded together and sintered to prepare the conductive grinding wheel. Next, conductive water-soluble grinding fluid containing an alkanolamine and anions is supplied between the grinding wheel and the electrode, and a voltage pulse wave is applied between the grinding wheel and the electrode to dress the grinding wheel electrolytically.

As mentioned above, the apparatus and method for mirror surface grinding of the first to fourth embodiments of the invention are characterized as follows. The grinding wheel is prepared by molding the wheel bond material, grains and the sintering aid together and sintering the molded article. The grinding wheel bond material is cast iron, ferrous metal, cobalt, nickel or a combination of two or more thereof, and the grains are diamond or CBN grains whose average grain size is not more than 6am. Because of these characteristics, the grinding wheel is strong enough to substantially resist wear through contact with the works, and can be dressed by electrolytic etching. ELID grinding can therefore be conducted very well.

Furthermore, since a pulse wave is used in the first to fourth embodiment of the invention, a non-conductive film of adequate thickness can be produced at the right time, whereby the current becomes constant and ELID grinding can be conducted very well. Mirror surfaces can be thus obtained.

Furthermore, since the conductive fluid is a water-soluble grinding fluid which contains an inorganic salt, alkanolamine and an anion, the following advantages are obtained. Namely, adequate electrolytes and conductivity are maintained in ELID grinding. Moreover, the non-conductive film functions as a lubricant when in contact with the workpiece. Further, the alkanolamine forms a complex with metal ions of the bond material so that it helps them to dissolve, keeps the pH of the grinding fluid alkaline and maintains the anti-corrosive property of the fluid. Further, the non-conductive film becomes porous so as to attain an anion effect which keeps the electrolytic dissolution constant so that the ELID grinding can be conducted continuously.

The fifth embodiment of the invention is described below.

The grinding wheel for electrolytic dressing which exhibits mechano-chemical action according to the fifth embodiment of the invention is especially suitable for grinding a semiconductor substrate such as Si, glass, optical parts such as sapphire, a magnetic head such as ferrite, jewels such as quartz and sapphire, and ceramics such as $Cr_3C_2$, $Si_3N_4$ and SiC. These materials can be ground efficiently by mechano-chemical action, and are easily flawed when using a superabrasive such as diamond grains.

The grinding wheel according to the fifth embodiment of the invention comprises grains consisting of metal oxides that exhibit mechano-chemical action and a metal binder which retains the grains therein. The metal oxide exhibiting mechano-chemical effect is preferably cerium oxide ($CeO_2$), chromium oxide ($Cr_2O_3$), zirconium oxide ($ZrO_2$), or silicon oxide ($SiO_2$). However, other metal oxides which can provide mechano-chemical effect can also be used.

The metal binder is preferably iron powder, cast iron powder or cobalt powder, although it is not limited to these. Other conductive metals which can be sintered and can retain grains therein can be used. Furthermore, a slight amount of sintering aid is preferably added to the metal binder. The sintering aid is preferably carbonyl iron powder, but is not limited thereto.

The preparation of the grinding wheel according to the fifth embodiment of the invention will now be explained. First, grains consisting of metal oxides that exhibit mechano-chemical effect are mixed with the metal binder to obtain a powder mixture. The metal oxides exhibiting mechano-chemical effect are selected from the group consisting of cerium oxide ($CeO_2$), chromium oxide ($Cr_2O_3$), zirconium oxide ($ZrO_2$), and silicon oxide ($SiO_2$). The grain size is appropriately chosen in light of the desired surface roughness of the processed surface. It can be larger than the grain size of diamond grains. For example, for obtaining a mirror surface with a maximum surface roughness of not more than 60 nm, #2000 grains (average grain size: 6.88 $\mu$m) are suitable. This size is much larger than the size of diamond grains (#4000, average particle size of not more than 4.06 $\mu$m) necessary to obtain a mirror surface with the same roughness. Accordingly, high grinding efficiency can be obtained by using larger grains.

The metal binder is selected from the group consisting of iron powder, cast iron powder and cobalt powder. Furthermore, a slight amount of sintering aid is added to the metal binder, which improves its sintering property, its ability to retain grains and the strength of the grinding wheel.

The amount of the grains which can provide a mechano-chemical effect is a grain concentration (or convergent rate) of 50 to 200 (about 2.2 to 8.8 carat/cm3), especially 100 to 200. The grain concentration is a volume/volume measure of the amount of the grains. Specifically, a grain concentration of 100 means 25 parts by volume per 100 parts by volume, or, in other words, 25% by volume equals 100. With a higher grain concentration of mechano-chemical grains than that for diamond grains, i.e. 50 to 100, a grinding wheel having high grinding efficiency can be obtained, even though the hardness of the grains is low. Furthermore, even at the same grain concentration, i.e. 50 to 100, high grinding efficiency can be obtained for some materials.

Thereafter, the resultant powder mixture is compression molded in an appropriate die to obtain a molded article. The compression molding pressure is preferably 6 to 8 t/cm2. The die recess can be of any shape such as square, circular, or fan-shaped. Generally, it is difficult to compress a large area evenly, and a press with a very high output is necessary to compress a large area at one time. Accordingly, as will be understood from the explanation that follows, the die may have a shape corresponding to a segment of the contact surface of the grinding wheel.

Thereafter, the molded material is sintered. Sintering is conducted in an inert gas such as argon gas (Ar) or nitrogen gas ($N_2$) at a temperature of not less than 1000, preferably 1100° C. to 1150° C.

The grinding wheel may be formed in segments which are made to adhere to a base with conductive adhesive to prepare the desired grinding wheel. According to this method, a large grinding wheel can be made from small segments. In such a case, it is preferable to arrange small cores in the base so as to reach to the segments, and pour a low melting metal such as solder into the interstices in order to improve the conductivity between the segments and the base. This method makes it possible to use a low conductivity adhesive, and to prepare the grinding wheel at low cost.

The apparatus for grinding which uses the grinding wheel according to the fifth embodiment of the invention will now be described.

Figure 8:
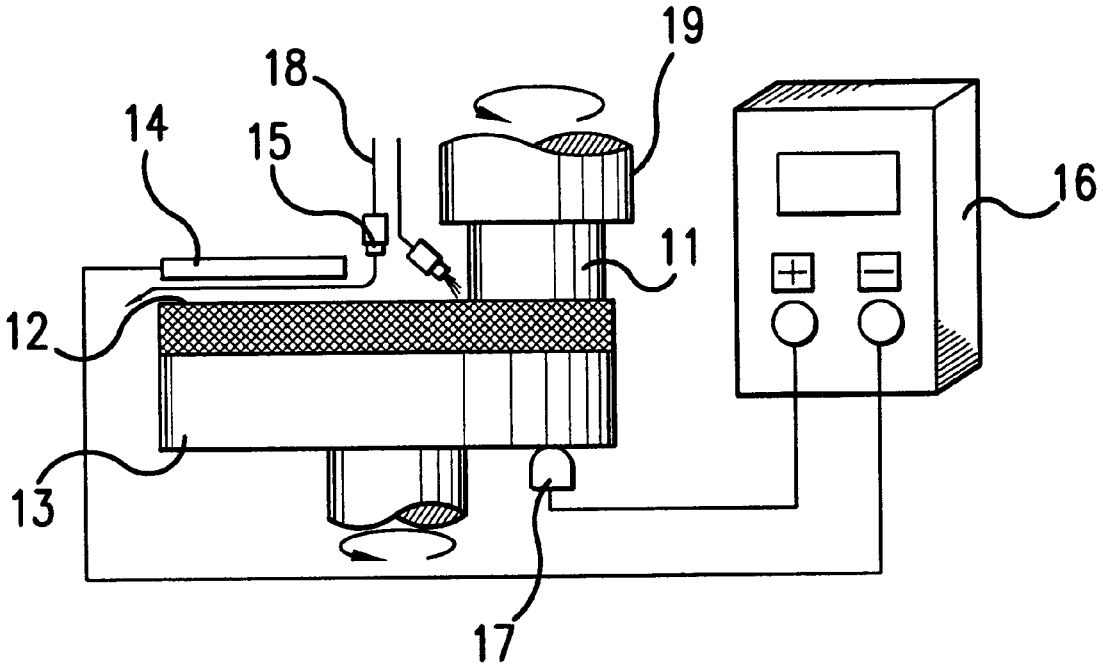
FIG. 8 is a schematic view of a flat surface grinding apparatus using the grinding wheel in accordance with the fifth embodiment of the invention.

FIG. 8 is a schematic view of a flat surface grinding apparatus using the grinding wheel according to the fifth embodiment of the invention.

In FIG. 8, reference numeral 13 designates a substantially disk-shaped conductive wheel having a vertical axis, which is rotated around the axis by a driving gear (not shown) with its contact surface 12 facing upward. Above the grinding wheel 13 is a rotatable drive shaft 19 attached to the upper head of the processing apparatus (not shown). The drive shaft 19 can move horizontally and vertically. A workpiece 11 is fixed on the undersurface of the drive shaft 19 by a known method.

The upper surface of the grinding wheel 13, namely the contact surface 12, has a horizontal cutting profile. The workpiece 11 is ground by contact with the rotating contact surface 12.

An electrode 14 is disposed above a part of the grinding wheel 13 which does not contact with the workpiece 11 so as to face the contact surface 12 across a gap. Nozzles 15 are arranged around the grinding wheel 13 for feeding grinding fluid or coolant through a feed pipe 18 to the gap between the grinding wheel 13 and the electrode 14. The nozzles 15 are preferably also arranged so as to feed coolant to the gap between the grinding wheel 13 and the workpiece 11.

Furthermore, the apparatus is equipped with a power supply 16 for applying a positive voltage to the grinding wheel 13 through a feeder 17 and applying a negative voltage to the electrode 14. Differently from what is shown in FIG. 8, the feeder 17 may be arranged so as to contact with the side surface of the grinding wheel 13. The power supply 16 is preferably a pulse power supply or a power supply which provides a pulse wave and direct electric current in combination (also referred to as a ripple wave).

Figure 9:
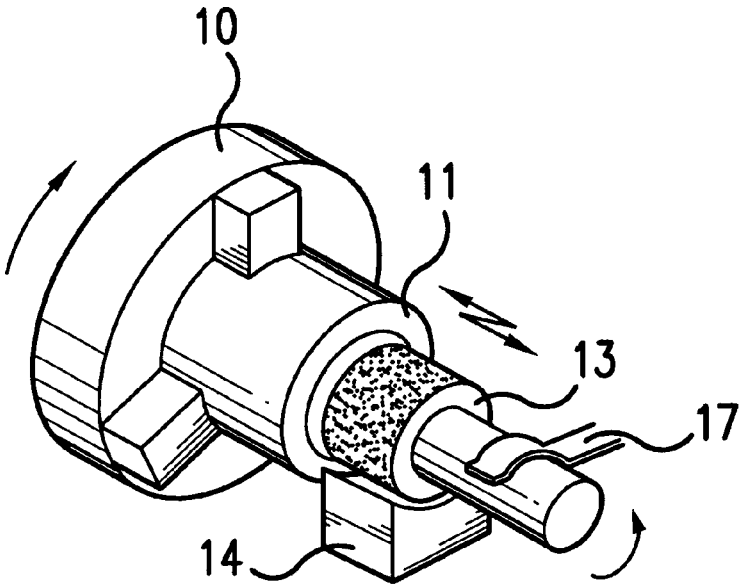
FIG. 9 is a schematic view of an inner surface grinding apparatus using the grinding wheel in accordance with the fifth embodiment of the invention.

FIG. 9 is a schematic view of an inner surface grinding apparatus using the grinding wheel according to the fifth embodiment of the invention. In the figure, the same numerals are used for the same parts as in FIG. 8. In FIG. 9, the workpiece 11 is set on a rotating chuck 10 of a turning center processing machine (not shown). The grinding wheel, which has a shaft 20, is set on a chuck (not shown) so as to face the workpiece. The chuck can reciprocate in the axial direction. An electrode, namely the feeder 17, is disposed to contact the shaft 20 of the grinding wheel. An electrode for electrolytic dressing 14 is fixed on a part of the grinding machine (not shown) and supported thereon. A coolant is fed to the gap between the grinding wheel and the electrode.

In the inner surface grinding apparatus shown in FIG. 9, the grinding wheel is rotated in a direction opposite to that of the workpiece 11, and grinding is conducted with feed and traverse. On the other hand, the grinding wheel is reciprocated in the axial direction, and is subjected to electrolytic dressing between the grinding wheel and the electrode 14 after separating from the workpiece 11. Thus, ELID grinding can be conducted for a workpiece having a relatively small core by alternately carrying out electrolytic dressing and grinding.

EXAMPLE 1

A plane grinding test was conducted using the plane grinding apparatus of FIG. 8 equipped with the grinding wheel for electrolytic dressing according to the fifth embodiment of the invention which exhibits mechano-chemical action.

The grinding wheel used for the test was prepared by embedding grains of #2000 cerium oxide ($CeO_2$) in a metal bond material. Grinding wheel segments were prepared using carbonyl iron powder as sintering aid and grains with a grain concentration of 150, in accordance with the earlier described preparation method. Thereafter, the thus-prepared segments were glued to a base with an adhesive to prepare a disk-shaped grinding wheel having a diameter of 250 mm. Furthermore, small cores reaching to the segment were arranged in the base, and solder was poured therein in order to improve the conductivity between the segments and the base.

ELID grinding was conducted using single-crystal silicon (Si) as the workpiece and a conventional power source.

Figure 10:
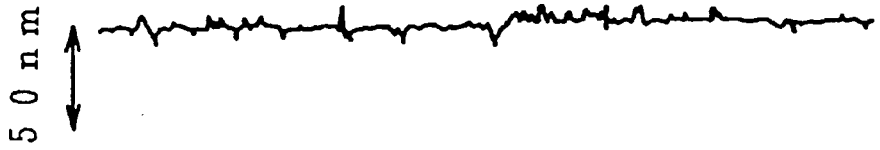
FIG. 10 shows the surface roughness of a silicon crystal plate ground by the grinding wheel in accordance with the fifth embodiment of the invention.

The surface roughness of the resultant ground surface is showed in FIG. 10. In this figure, the arrow represents 50 nm. It is clear from the figure that a very smooth mirror surface was obtained with the grinding wheel according to the fifth embodiment of the invention. The maximum surface roughness ($R_{max}$) of the mirror surface was 20 nm. This surface roughness corresponds to one obtained with a grinding wheel containing # 10000 diamond grains ($R_{max}$ not more than 30 nm) or finer grains. The grinding speed was substantially the same as with #2000 diamond grains, and the grinding efficiency was higher than with #4000 to #10000 diamond grains.

EXAMPLE 2

An inner face grinding test was conducted using the inner face grinding apparatus of FIG. 9 equipped with the grinding wheel for electrolytic dressing according to the fifth embodiment of the invention, which provides mechano-chemical action.

The grinding wheel used for the test was prepared by embedding grains of #2000 cerium oxide ($CeO_2$) in a binder consisting of cast iron powder. Segments of a grinding wheel were prepared using carbonyl iron powder as sintering aid and grains with a grain concentration of 150, in accordance with the earlier described preparation method. A grinding wheel comprising #2000 diamond grains was also used for comparison.

Figure 11:
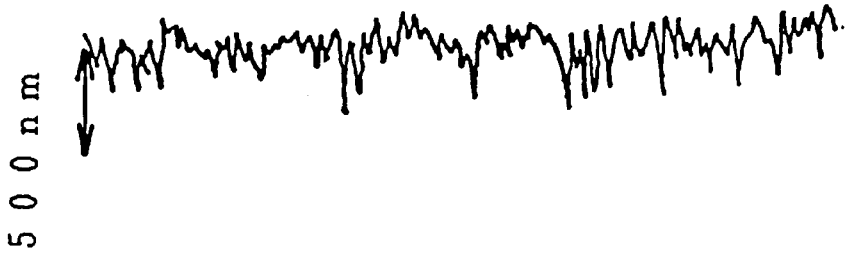
FIG. 11 shows the surface roughness of a workpiece ground by a conventional grinding wheel having #2000 diamond grains.
Figure 12:
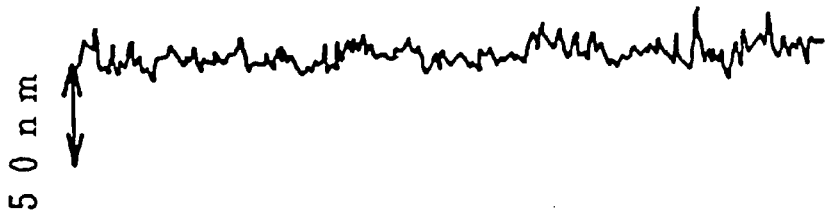
FIG. 12 shows the surface roughness of a workpiece ground by a grinding wheel having #2000 cesium oxide grains.
Figure 13A:
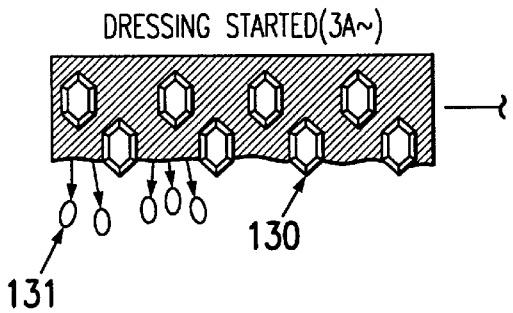
FIG. 13 is a schematic view showing the ELID cycle in ELID grinding.
Figure 13B:
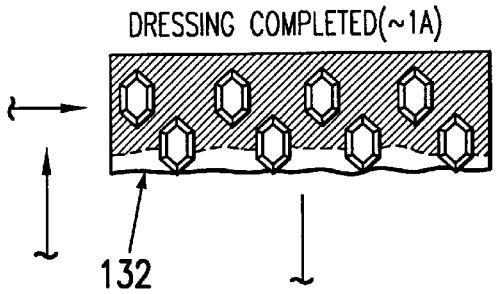
Figure 13C:
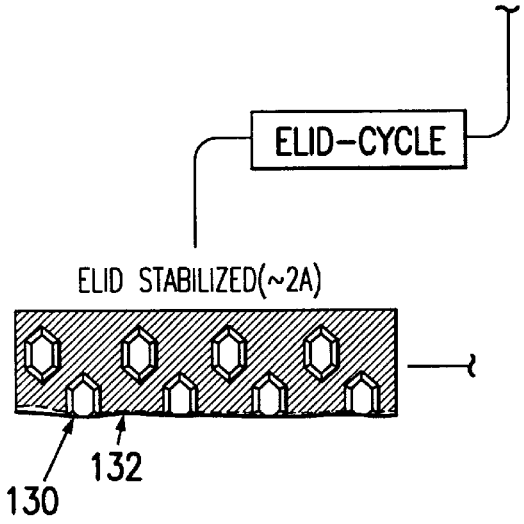
Figure 13D:
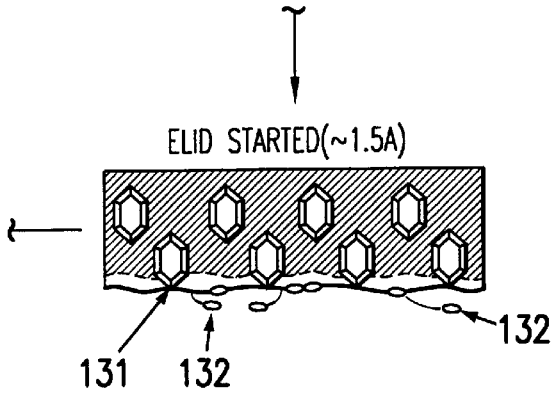

Optical glass was used as the workpiece to be ground. The surface roughnesses of the resultant ground surfaces are showed in FIGS. 11 and 12. FIG. 11 shows the surface roughness of the surface ground with the grinding wheel containing #2000 diamond grains. In the Figure, the arrow represents 500 nm. FIG. 12 shows the surface roughness of the surface ground with the grinding wheel containing #2000 cerium oxide ($CeO_2$) grains. In the figure, the arrow represents 50 nm. Namely, the scale of roughness represented by the arrow in FIG. 11 is ten times larger than that represented by the arrow in FIG. 12.

It is clear from FIG. 11 and FIG. 12 that a very smooth mirror surface was obtained with the grinding wheel according to the fifth embodiment of the invention, particularly in comparison with the surface obtained using the grinding wheel containing diamond grains. Namely, the maximum surface roughness ($R_{max}$) of the surface obtained with diamond grains was approximately 600 nm (0.606 $\mu$m), whereas the maximum surface roughness ($R_{max}$) of the surface obtained with the grinding wheel according to the fifth embodiment of the invention was approximately 44 nm. This surface roughness corresponds to one obtained with a grinding wheel containing #8000 diamond grains. The grinding speed was substantially the same as that with #2000 diamond grains.

As mentioned above, since the grinding wheel for electrolytic dressing according to the fifth embodiment of the invention comprises grains exhibiting mechano-chemical action, mechano-chemical action can be obtained. Furthermore, since the grains are embedded in a metal binder, ELID grinding using the ELID cycle can be conducted.

Mechano-chemical action is considered to be an effect in which the metal oxide exhibiting the mechano-chemical action works as a catalyst, and the silicon or glass of the workpiece to be ground reacts with water at the interface to bond covalently with the water. As a result, the grinding surface is softened and become easy to process with grains of low hardness. Accordingly, although metal oxides which exhibit mechano-chemical action have lower hardness than diamond grains, they can efficiently process a workpiece using the chemical removing effect of the mechano-chemical action. Furthermore, since, differently from diamond grains, their shape is not acicular, a mirror surface can be obtained with relatively large grains.

As mentioned above, according to the apparatus and the method of the first to fourth embodiments of the invention, the factors affecting ELID grinding are clarified, and therefore, high quality ELID grinding can be conducted continuously.

Furthermore, the grinding wheel according to the fifth embodiment of the invention, which comprises grains which exhibit mechano-chemical action, can conduct higher quality mirror surface grinding than is possible with a grinding wheel containing diamond grains. Such grains have been used in large amounts for polishing, etc, and are much cheaper than diamond grains. Thus, according to the present invention, mirror grinding can be conducted highly efficiently without using expensive diamond grains.

Furthermore, in ELID grinding using the grinding wheel according to the fifth embodiment of the invention, since the grains are not mixed with the conductive fluid, only a few grains used for grinding are incorporated in the fluid. Therefore the grains do not damage the grinding surface, and do not contaminate the vicinity of the grinding surface.

Although the present invention has been illustrated with respect to several preferred embodiments, one of ordinary skill in the art will recognize that modifications and improvements can be made while remaining within the scope and spirit of the present invention. The scope of the present invention is determined solely by the appended claims.

What is claimed is:

1. A process for grinding a silicon workpiece to a mirror finish, comprising the steps of:

providing a grinding wheel for electrolytic dressing comprising (a) grains of a metal oxide selected from the group consisting of cerium oxide, chromium oxide, zirconium oxide or silicon oxide, and (b) a metal bond material retaining the grains on said grinding wheel;

providing a silicon workpiece; and grinding the workpiece with a said grinding wheel while electrolytically dressing the grinding wheel.

2. A process for grinding a workpiece according to claim 1, wherein said metal oxide (a) is cerium oxide.

3. A process for grinding a workpiece according to claim 1, wherein said metal oxide (a) is silicon oxide.

4. A process for grinding a workpiece according to claim 1, wherein said metal oxide (a) is chromium oxide.

5. A process for grinding a workpiece according to claim 1, wherein said metal oxide (a) is zirconium oxide.

6. A method according to claim 1 wherein the grain concentration is 2.2 to 8.8 carat/$cm^3$.

7. A method according to claim 1 wherein the grain concentration is 4.4 to 8.8 carat/$cm^3$.

8. A process for grinding a workpiece to a mirror finish, comprising the steps of:

providing a grinding wheel for electrolytic dressing comprising (a) grains of a metal oxide selected from the group consisting of cerium oxide, chromium oxide, zirconium oxide or silicon oxide, wherein the average grain size of the grains is greater than about 6 $\mu$m, and (b) a metal bond material retaining the grains on said grinding wheel;

providing a workpiece; and grinding the workpiece with said grinding wheel to a surface roughness of about 60 nm or below while dressing the grinding wheel electrolytically.

9. A method according to claim 8 wherein the grain concentration is 2.2 to 8.8 carat/$cm^3$.

10. A method according to claim 8 wherein the grain concentration is 4.4 to 8.8 carat/$cm^3$.

11. A process for grinding a workpiece to a mirror finish comprising the steps of:

providing a grinding wheel for electrolytic dressing comprising (a) grains consisting essentially of a metal oxide selected from the group consisting of cerium oxide, chromium oxide, zirconium oxide or silicon oxide, and (b) a metal bond material retaining the grains on said grinding wheel;

providing a silicon workpiece; and grinding the workpiece with said grinding wheel while dressing the grinding wheel electrolytically.

12. A method according to claim 11 wherein the grain concentration is 2.2 to 8.8 carat/$cm^3$.

13. A method according to claim 11 wherein the grain concentration is 4.4 to 8.8 carat/$cm^3$.

* * * * *